US005657645A

United States Patent [19]

Abraham

[11] Patent Number: 5,657,645

[45] Date of Patent: Aug. 19, 1997

[54] SELF-LOCKING BREAKAWAY BAND

[76] Inventor: Carl J. Abraham, 3 Baker Hill Rd., Great Neck, N.Y. 11023

[21] Appl. No.: 599,787

[22] Filed: Feb. 12, 1996

[51] Int. Cl.[6] ..... A44C 5/00

[52] U.S. Cl. ..... 63/3; 63/DIG. 3

[58] Field of Search ..... 63/3, 4, 5.1, DIG. 3; 40/633; 24/16 PB, 30 SP

[56] References Cited

U.S. PATENT DOCUMENTS 1,709,181 4/1929 Matlock ..... 63/3

3,766,608 10/1973 Fay ..... 24/16 PB 4,942,644 7/1990 Rowley ..... 24/16 PB

*Primary Examiner*—Kien Nguyen

*Attorney, Agent, or Firm*—Levine & Mandelbaum

[57] ABSTRACT

A bracelet has a guide aperture at one end, a barb at the opposite end, and elongated holes running along its length. The barbed end can be pulled through the guide aperture and then twisted and inserted into an adjacent hole for being captured therein. The barb is connected to the bracelet by a frangible neck which will break under tension sufficient to otherwise cause bodily injury upon snagging of the bracelet, thereby releasing it from the wrist of the wearer.

5 Claims, 1 Drawing Sheet

SELF-LOCKING BREAKAWAY BAND

BACKGROUND OF THE INVENTION

This invention relates to bracelets worn on the wrist or ankle. More specifically, the invention is directed to the construction of an inexpensive self-locking and disposable bracelet for containing an insect repellant as described in my copending application, Ser. No. 08/556,291 now U.S. Pat. No. 5,603,231. Various arrangements for bracelets which may be worn as jewelry or to support a wrist watch or other article of jewelry are known. Not only are such bracelets are relatively expensive and unsuitable where an inexpensive and disposable bracelet is required, they are potentially hazardous if caught or snagged on a machine or other forceful instrumentality. For example, U.S. Pat. No. 2,359,148 to Partridge for a wrist watch strap discloses a stitchless watch band having a tongue section and a buckle section. The buckle section has a barb and a series of elongated rounded openings to form the buckle strap section of a wrist band. The wrist band requires a separate buckle and is not a one-piece construction. A barb and slot arrangement is provided for fastening the buckle to the strap but it is not suitable for securing the band on the wrist. No safety release is provided.

Also known in the art are constructions of straps for wrapping around and securing various materials. British Patent No. 1,023,438 for Improvements in or Relating to Cable Clamps explains the construction of a cable holding strap molded from a plastic material such as polyethylene. The clamp has a guide opening at one end and a barb at the other. There is a single elongated opening between the guide opening and the barb. Unlike a wrist band, in use the strap is passed through the guide to form a first loop around a cable and a second loop around a wire is then made by inserting the barb into the elongated opening.

U.S. Pat. No. 4,942,644 to Rowley for a Strap Hanger discloses a strap which can be molded from high density polyethylene. The strap has barbs at both ends and one or more slots to enable the strap to accommodate various sizes of bundles of wires, pipes and the like which are to be tied. The slots are partially elongated with rounded corners but have widened portions at one or both ends. U.S. Pat. No. 1,829,613 to Sato for a Fastener discloses a binding strap for loose leaves. Diagonal slots are provided near one end of the fastener for receiving a barb on the opposite end.

U.S. Pat. No. 4,991,536 to Moshofsky for a Marker for Buried Objects discloses a device in the nature of a strap to be looped around a wire so that the wire can be located. The strap has an elongated opening with rounded ends. A collapsible tongue is inserted into the opening to secure the marker. U.S. Pat. No. 1,945,932 to Caley for a Hair Curler or Waver discloses various rubber strips each of which has a barb at one end, an opening at the other end and a slit between the ends.

British patent specification 346,341 for Improvements in Band Clip or Like Fasteners discloses various fasteners having rectangular and T-shaped slots for receiving a barbed end. Each slot has rectangular corners. In one embodiment multiple barbs are employed to accommodate various sizes. French patent no. 1,086,297 discloses a fastener having a barbed end and an opposite apertured end.

None of the foregoing designs is concerned with or discloses a bracelet which can be safely and securely worn, yet releasable upon application of excessive force, i.e., 5 pounds or more. Snagging or catching of a bracelet on a power tool, vehicle or other instrumentality can cause severe bodily injury if the bracelet is pull hard enough while it is on the wrist of a wearer.

SUMMARY OF THE INVENTION

The aforementioned shortcomings of the prior art are overcome by the instant invention which provides for a plastic bracelet having a guide loop on one end, a barb on the opposite end connected by a weakened and frangible neck to the main body of the bracelet, and elongated rectangular holes with rounded corners running along its length. In use, the barbed end is slipped through the guide loop and pulled until the bracelet is snug around the wrist. The barb is then twisted and inserted into an adjacent hole. When the barb is released, it returns to a plane transverse to the length of the receiving hole wherein it is then captured. The guide loop helps maintain alignment of the band when worn. The bracelet may be manually released by twisting the barb and extracting it through the aperture into which it was inserted, or automatically upon application of sufficient force by having the frangible neck break to separate the barb from the main body of the bracelet.

It is therefore an object of the invention to provide a bracelet which is inexpensive enough to be disposable yet which can be comfortably and safely worn.

Another object of the invention is to provide a bracelet which can be readily separate from the wearer upon application of sufficient force to otherwise cause bodily injury.

Still another object of the invention is to provide an inexpensive bracelet with a weakened portion which is frangible under tension.

A further object of the invention is to provide a bracelet having openings along its length for receiving a barb mounted on a frangible neck thereof whereby the barb can be readily detached from the bracelet upon fracturing of the neck for enabling the bracelet to be separated from the wrist of the wearer upon application of potentially injurious force.

Other and further objects of the invention will be apparent from the following drawings and description of a preferred embodiment of the invention in which like reference numerals are used to indicate like parts in the various views.

DESCRIPTION OF THE PREFERRED EMBODIMENT

Figure 1:
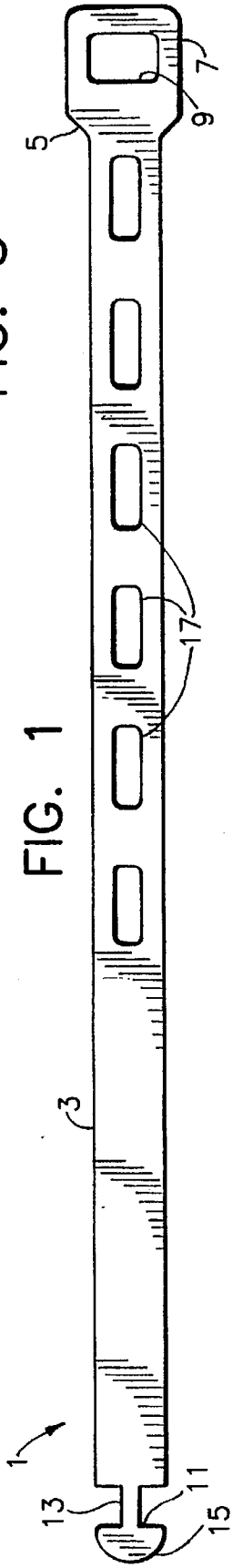
FIG. 1 is a plan view of a self-locking adjustable bracelet in accordance with the preferred embodiment of the invention.

Referring now to FIG. 1 of the drawings, there is shown a bracelet 1 in the form of an elongated relatively narrow web of a durable light-weight plastic material, suitable for molding, such as polyethylene or polyurethane. A web portion 3, comprising the major length of the bracelet 1, preferably has a width of approximately 0.5 inches and a thickness in the range of from 0.06 to 0.25 inches.

At one end of the bracelet 1 there is an outward taper 5 terminating in a widened substantially rectangular stub 7 having a substantially rectangular aperture 9. The corners of the rectangular aperture 9 are rounded as are the two extreme exterior corners of the stub 7. The length of the aperture 9 is parallel to the width of the web 3, i.e., transverse to its longitudinal axis, and is equal to or just slightly greater than the width of the web 3. That is, where the width of the web 3 is 0.5 inches, the length of the aperture 9 would preferably be in the range of 0.5 to 0.7 inches. The radius of curvature of each corner of the aperture 9 is approximately 0.08 inches.

The width of the aperture 9 along a dimension parallel to the longitudinal axis of the web portion 3 and transverse to the width of the web portion 3 is less than its length but greater than the thickness of the bracelet web portion 3. In the preferred embodiment where the width of the web 3 is 0.5 inches, the width of the aperture 9 would preferably be in the range of 0.3 to 0.4 inches for a bracelet having a web thickness of up to 0.25 inches and 0.1 to 0.4 inches for a web thickness of as little as 0.06 inches.

At the end of the bracelet 1 opposite the end having the stub 7 is a connector portion 11 defined by a step in the width of the web 3 forming a neck 13 having a width of approximately 0.125 inches followed by a semicircular barb 15, the width of the barb 15 in a direction transverse to the longitudinal axis of the web 3 being substantially equal to the width of the web 3, and the thickness of the neck 13 and barb 15 being substantially equal to the thickness of the web 3 whereby each of the web 3, neck 13, barb 15 and stub 7 has a rectangular cross section transverse to the longitudinal axis of the web 3. The end-to-end length of the bracelet 1 measured from an apex of the barb 15 to a distal edge of the stub 7 is 11⅛ inches in the preferred embodiment of the invention. Although this dimension will be suitable for most wrists, variations may be made within the scope of the invention to accommodate smaller or larger appendages.

The width of the neck is preferably 15%–35% that of the web 3, the neck 13 being frangible for breaking away from the web 3 and/or barb 15 upon application of force, e.g., 5 pounds or more, sufficient to cause bodily injury to the wearer of the bracelet. The neck preferably has a circumference in the range of between 0.2 inches and 0.6 inches in order to provide sufficient security of the bracelet on the wearer yet enabling it to be released upon application of dangerous force.

Evenly spaced along the longitudinal axis of the web 3 and spanning approximately two thirds of the length of the web portion 3, beginning proximate the outward taper 5 of the bracelet 3, are a series of like-dimensioned, evenly spaced, rectangular apertures 17 having rounded corners which serve as locking holes for the barb 15. The width of each of the apertures 17 in a direction parallel to the width of the web 3 and transverse to the longitudinal axis of the web 3 is preferably equal to or slightly less than one half the width of the bracelet web portion 3, and its length in a direction parallel to the longitudinal axis of the web 3 is slightly greater than the width of the barb 15, e.g., in the preferred embodiment of the invention with a barb 15 having a width of 0.5 inches, the web 3 has apertures 17 with a width of 0.214 inches and a length of 0.6 inches. The radius of curvature of each corner of each aperture 17 is approximately 0.08 inches.

The spacing between the apertures 17 will depend on the thickness of the web portion 3, the greater the thickness, the closer the spacing permitted. In the preferred embodiment of the invention, with a web portion 3 having a width of 0.5 inches and a thickness of approximately 0.125 inches, the spacing between adjacent extremities of the apertures 17 is preferably on the order of 0.375 inches.

Figure 4:
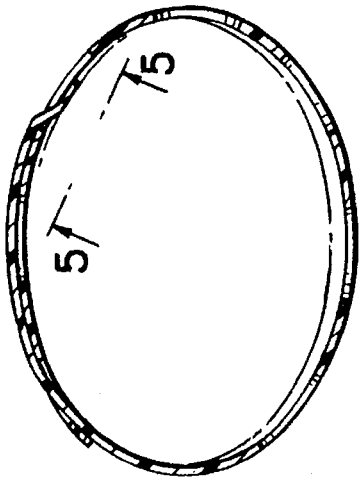
FIG. 4 is a cross sectional view of a self-locking adjustable bracelet in accordance with the preferred embodiment of the invention taken through line 4—4 of FIG. 2.
Figure 5:
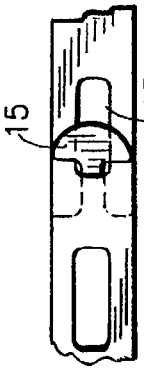
FIG. 5 is a fragmentary plan view of a self-locking adjustable bracelet in accordance with the preferred embodiment of the invention shown in another stage of use.
Figure 3:
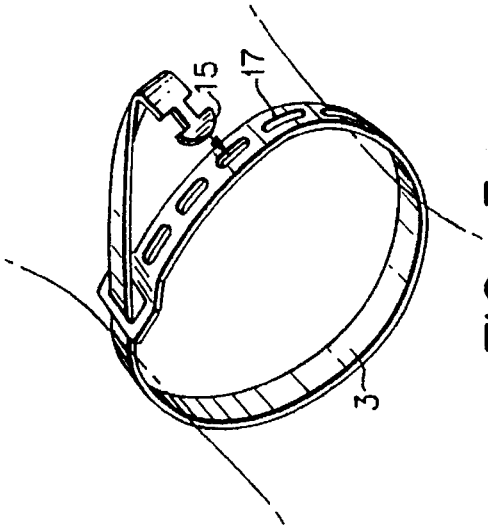
FIG. 3 is a perspective view of a self-locking adjustable bracelet in accordance with the preferred embodiment of the invention shown in one stage of use.
Figure 2:
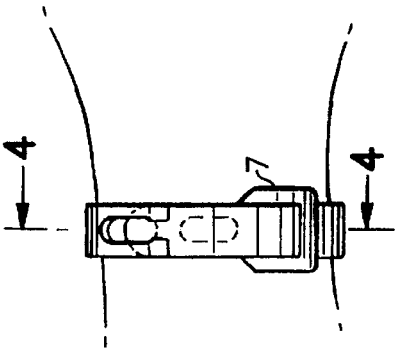
FIG. 2 is an environmental view of a self-locking adjustable bracelet in accordance with the preferred embodiment of the invention.

Referring now to FIGS. 2–5, in use, the bracelet 1 is wrapped about the wrist (or ankle) of a person and the barb 15 is inserted through the rectangular aperture 9 in the stub 7 and pulled through until a snug enough fit is obtained to prevent movement of the bracelet 1 relative to the wrist or, if a loose fit is desired, to prevent the bracelet from sliding over the hand of the wearer. The barb 15 is then twisted approximately 90 degrees, as best seen in FIG. 3, to align its width with the length of the nearest aperture 17 through which the barb 15 is then inserted. The barb 15 is then released thereby permitting the resilience of the plastic material from which the bracelet 1 is molded to restore the barb to its original orientation as best seen in FIG. 5. The barb 15 is thereby prevented from being withdrawn through the aperture 17 and the neck 13 is captured within the aperture 17.

Should the bracelet become snagged on a power tool, vehicle or other instrumentality capable of applying potentially injurious force, the frangible neck will break thereby separating the barb 15 inserted into the aperture 17 from the web 3 disposed outside of the aperture 17. The force will then have the effect of pulling the web back through the aperture 9 of the stub 7 until the bracelet is slid over the hand of the wearer or the web 3 is fully withdrawn so that the bracelet simply unravels and is removed from the wrist.

To remove the bracelet under normal conditions, i.e., when dangerous force has not been applied, the wearer need only twist the barb 15 again to align it with the aperture 17 at which time the barb 15 can be passed back through the aperture 17 and then withdrawn through the aperture 9 in the stub 7. Depending on the size of the hand of the wearer, it may be possible to slide the bracelet over the hand by partially withdrawing the web portion 3 through the stub 7 without causing the barb 15 to pass through the stub aperture 9.

It is to be appreciated that the foregoing is a description of a preferred embodiment of the invention to which variations and modifications may be made without departing from the spirit and scope of the invention.

What is claimed is:

1. A bracelet comprising an elongated web of a light weight flexible material having a first end and a second end, an intermediate portion between said first end and second end, and a longitudinal axis extending from said first end to said second end along a centerline of said bracelet;

said first end comprising stub means wider than said intermediate portion, said stub means having an aperture with a dimension transverse to said longitudinal axis which is at least as long as a dimension of said intermediate portion transverse to said longitudinal axis for enabling said intermediate portion to be slidable within said stub aperture;

said second end comprising barb means and neck means connected to said barb means and to said intermediate portion, said neck means having a dimension transverse to said longitudinal axis which is less than a dimension of said intermediate portion transverse to said longitudinal axis and less than a dimension of said barb means transverse to said longitudinal axis and a tensile strength less than the tensile strengths of said barb means, stub means and intermediate portion;

said intermediate portion having a plurality of locking apertures spaced in the direction of said longitudinal axis, each of said apertures having a dimension parallel to said longitudinal axis which is greater than the maximum dimension of said barb means transverse to said longitudinal axis, and each of said apertures having a dimension transverse to said longitudinal axis which is less than the maximum dimension of said barb means transverse to said longitudinal axis and greater than a dimension of said neck means transverse to said longitudinal axis, whereby said barb means can be inserted through said stub means aperture and said intermediate portion can thereafter be slid through said stub means aperture to form said bracelet into a loop of desired size, and whereby said barb means can then be inserted into and captured within one of said locking apertures, said bracelet being frangible at said neck means for breaking and causing said bracelet to open, upon application of sufficient tension.

2. A bracelet according to claim 1 wherein said material is selected from the group consisting of polyethylene and polyurethane.

3. A bracelet according to claim 1 wherein said neck means has a circumference in the range of between 0.2 inches and 0.6 inches.

4. A bracelet according to claim 3 wherein said neck means has a thickness substantially equal to the thickness of said bracelet intermediate portion and a width in the range of 15% to 35% of the width of said intermediate portion.

5. A bracelet according to claim 1 wherein said neck means has a tensile strength of no more than 20 pounds and said intermediate portion has a tensile strength of at least 30 pounds.

* * * * *